US005160191A

United States Patent [19]

Holland et al.

[11] Patent Number: 5,160,191

[45] Date of Patent: Nov. 3, 1992

[54] ADJUSTABLE REFRIGERATOR DOOR SHELF RETAINER

[75] Inventors: James R. Holland, Gowen; Charles J. Hoffman, Kentwood, both of Mich.

[73] Assignee: White Consolidated Industries, Inc., Cleveland, Ohio

[21] Appl. No.: 780,709

[22] Filed: Oct. 18, 1991

[51] Int. Cl.[5] ..... A47B 81/00

[52] U.S. Cl. ..... 312/405.1; 312/321.1; 312/408

[58] Field of Search ..... 312/321.5, 405.1, 405, 312/408; 248/298

[56] References Cited

U.S. PATENT DOCUMENTS

| | | | |
|---|---|---|---|
| 2,917,355 | 12/1959 | Squire . | |
| 3,029,953 | 4/1962 | Morrissey, Jr. . | |
| 3,156,509 | 11/1964 | Padgett | 312/405.1 |
| 3,402,907 | 9/1968 | Fisher . | |
| 3,652,032 | 3/1972 | Eros et al. . | |
| 3,682,521 | 8/1972 | Kesling . | |
| 3,709,576 | 1/1973 | Lemoine . | |
| 3,982,798 | 9/1976 | Fellwock et al. . | |
| 4,186,978 | 2/1980 | Thomson . | |
| 4,642,888 | 2/1987 | Love | 248/298 X |
| 4,740,042 | 4/1988 | Stich et al. . | |
| 4,770,314 | 9/1988 | Giesler . | |
| 4,815,685 | 3/1989 | Roberts et al. . | |
| 4,921,315 | 5/1990 | Metcalfe et al. . | |
| 4,964,605 | 10/1990 | Bejer et al. | 248/213 X |

*Primary Examiner*—Joseph Falk

*Attorney, Agent, or Firm*—Pearne, Gordon, McCoy & Granger

[57] ABSTRACT

A horizontally adjustable retainer for a refrigerator door shelf is provided. The retainer is a unitary injection molded piece having an elongated vertical front wall and two vertical sidewalls which extend from the ends of the front wall in the same direction and substantially at right angles from the front wall. The top edge of each sidewall is provided with a resilient depressible projecting release integral to the retainer and having a plurality of spaced recesses for engaging the top edge of a pair of rectangular apertures provided in a refrigerator door liner for receiving and supporting the retainer. A plurality of spaced notches vertically aligned with the recesses are provided at the bottom edge of each sidewall for engaging the bottom edges of the apertures in the door liner. A notch and its associated recess at each sidewall cooperate to rigidly affix the retainer to the refrigerator door liner at one of various positions associated with each notch-recess pair. The retainer can be easily adjusted to accommodate items of varying widths which are supported on an associated shelf.

13 Claims, 6 Drawing Sheets

ADJUSTABLE REFRIGERATOR DOOR SHELF RETAINER

BACKGROUND OF THE INVENTION

1. Field of the Invention

The invention relates generally to a retainer for holding items on a refrigerator door shelf, and more particularly to a retainer which can be rigidly mounted at various positions to accommodate items of varying widths which are being retained on the associated shelf.

2. Description of Related Art

Household refrigerators are generally provided with a plurality of shelves which extend from or are an integral part of the refrigerator door liner. These door shelves provide for better utilization of refrigerator storage space, convenient organization of refrigerated items, and easy access to stored items. A typical refrigerator door will have specialty shelves for retaining such items as eggs or butter, and one or more flat shelves for retaining cans, jars, bottles and the like. Lateral support of stored items retained on the flat shelves is achieved by providing a front retainer or a vertical wall extending in front of each shelf to prevent the items from tipping or sliding off the shelves when the refrigerator door is opened or closed. The shelves and retainer are generally immovably fixed to the refrigerator door or door liner and cannot be adjusted horizontally to accommodate variously sized items.

A vertically adjustable shelf having depressible tabs secured at each end of the shelf with each tab having retaining lugs which engage mounting lugs provided between support surfaces of the interior wall of a refrigerator door is described in U.S. Pat. 3,682,521. Other means for removably mounting shelves in a plurality of vertically spaced positions on a refrigerator door are provided by U.S. Pat. Nos. 2,917,355 and 3,029,953.

Thus, while means are known for providing vertically adjustable shelves to accommodate stored items of varying height, these devices are not capable of horizontal adjustment to securely support items of differing diameter or width. A horizontally adjustable refrigerator door shelf retainer capable of accommodating items of varying diameter or width would therefore be highly desirable.

SUMMARY OF THE INVENTION

A retainer for providing lateral support for items being stored on a refrigerator door shelf and which is horizontally adjustable to accommodate items of various widths on the shelf is provided.

The retainer is preferably a unitary injection molded part made from a strong and durable resilient plastic, such as a polyolefin or a polyacrylic styrene, with acrylic butadiene styrene being the most preferred material.

The retainer has an elongated vertical front wall portion which is substantially parallel with the plane of the refrigerator door, and is substantially coextensive with an associated refrigerator door shelf. The front wall portion of the retainer is spaced from and connected to an interior door liner by means of vertical sidewall portions which extend at substantially right angles from each end of the front wall portion into supporting rectangular shaped apertures sized to receive the ends of the sidewall portions opposite the front wall portion. The retainer is preferably hollow and open at the bottom so as to provide a vertical cross section having a substantially inverted U-shaped appearance.

A resilient, depressible projecting release having a plurality of spaced recesses is provided at the edge of each sidewall portion and a plurality of spaced notches corresponding to the recesses is provided along the opposite edge of each sidewall portion. The recess and notches engage the top and bottom edges of the aperture in the liner wall and thereby support the retainer on the liner wall at any of a plurality of predetermined positions corresponding to the spacing of the Plurality of recesses and their corresponding notches to provide a horizontally adjustable retainer for a refrigerator door shelf which is capable of securely accommodating items of various width.

DESCRIPTION OF THE PREFERRED EMBODIMENT

Figure 1:
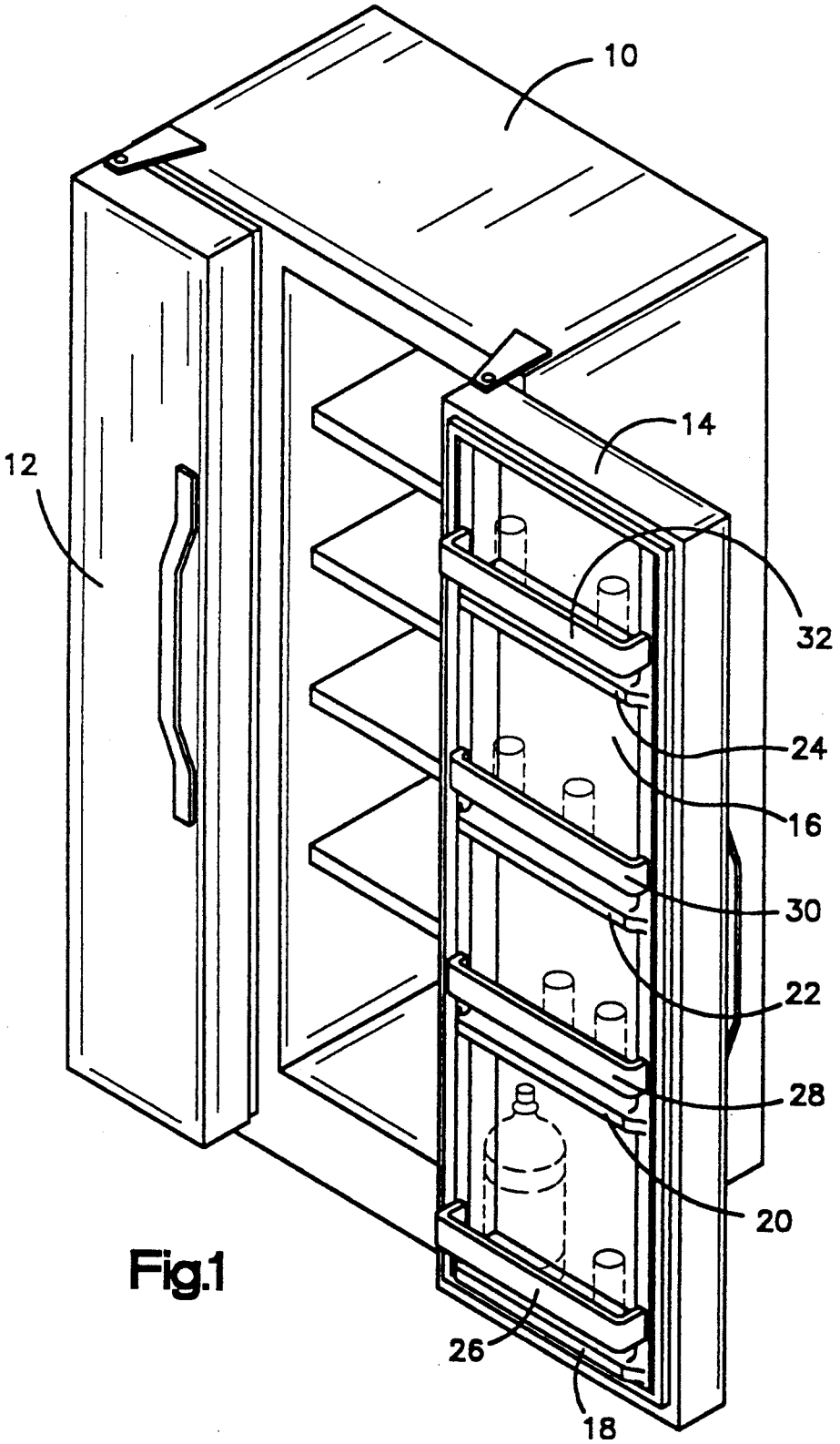
FIG. 1 shows a perspective view of a refrigerator having two doors with one of the doors open to show interior shelves and associated retainer on the refrigerator door.

Referring to FIG. 1, a dual compartment refrigerator 10 having two pivotally hinged, side-by-side doors is shown with the right front door 14 in the open position and the left front door 12 in the closed position. The right front door has an inner door liner 16 formed from a suitable plastic sheet, preferably made from an acrylic butadiene styrene copolymer or from a polyolefin. The door liner is formed to include integral shelves 18, 20, 22 and 24 for storing refrigerated food items. Each shelf has an associated retainer 26, 28, 30 and 32 for providing lateral support for items being stored on the shelves, and. in particular, for preventing stored items from tipping or sliding off the shelves when the refrigerator door is swung open or closed. In accordance with the invention, the retainers are removable and can be adjusted horizontally to securely accommodate items of varying width.

Figure 2:
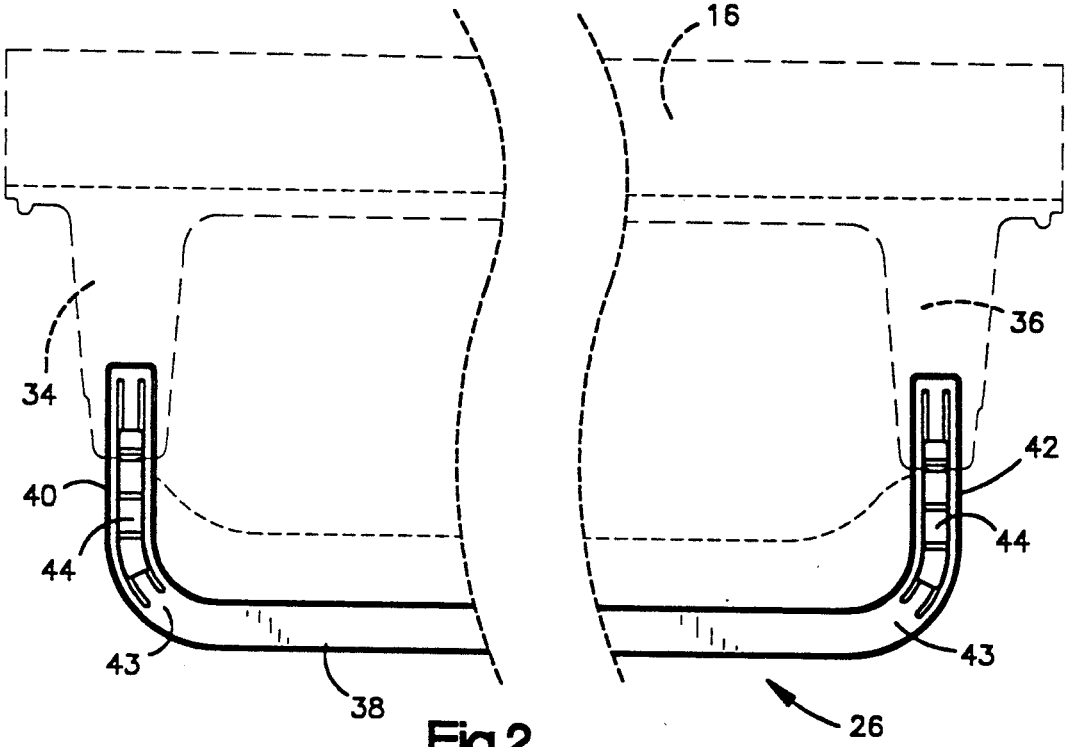
FIG. 2 is a top plan view of an adjustable retainer for a refrigerator door shelf in accordance with a first embodiment of the invention disclosed herein.
Figure 3:
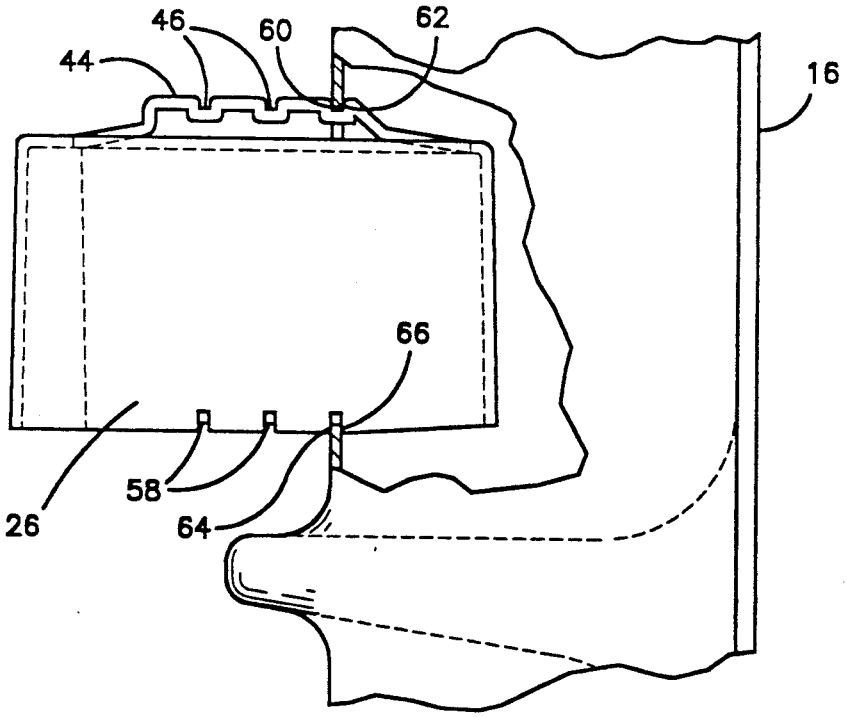
FIG. 3 is a side elevational view of the adjustable retainer shown in FIG. 2 mounted on a refrigerator door liner.
Figure 7:
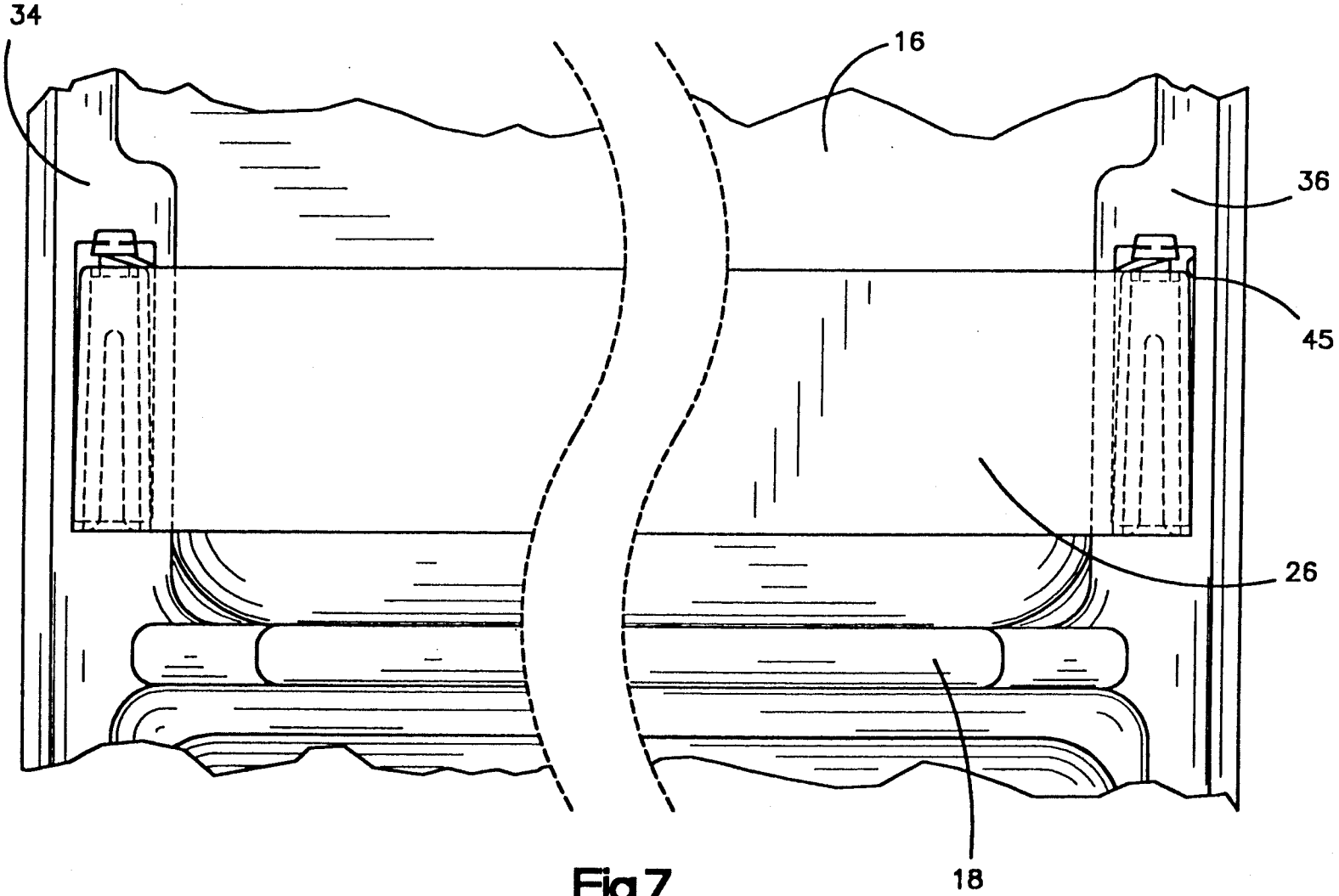
FIG. 7 is a front elevational view of the adjustable retainer shown in FIG. 2.

With reference to FIGS. 2, 3 and 7, a retainer in accordance with the invention is shown installed to a refrigerator door liner at one of three interlocking positions. The refrigerator door liner, shown in phantom in FIG. 2, has parallel protruding edge walls 34 and 36 which extend vertically along the height of the refrigerator door and with the spacing between the edge walls defining the length of the door shelves. The edge walls are provided with substantially vertically elongated rectangular apertures 45 for snugly receiving the ends of, and for supporting, the retainer. As indicated by the break-away lines in FIG. 2, the shelves and retainer may be of any desired length depending on the configuration and size of the refrigerator door.

The horizontally adjustable retainer is preferably a unitary injection molded part made from a suitable resilient plastic material, with acrylic butadiene styrene copolymers and polyolefins being the most preferred materials.

Referring to FIG. 2, the retainer has an elongated vertical front wall portion 38 which when installed to the refrigerator door liner is substantially parallel to the plane of the refrigerator door and has a length approximately equal to that of the associated shelf. Extending, at substantially right angles, from each end of the front wall portion through the supporting rectangular apertures 45 in the door liner are two vertical sidewall portions 40 and 42.

Figure 4:
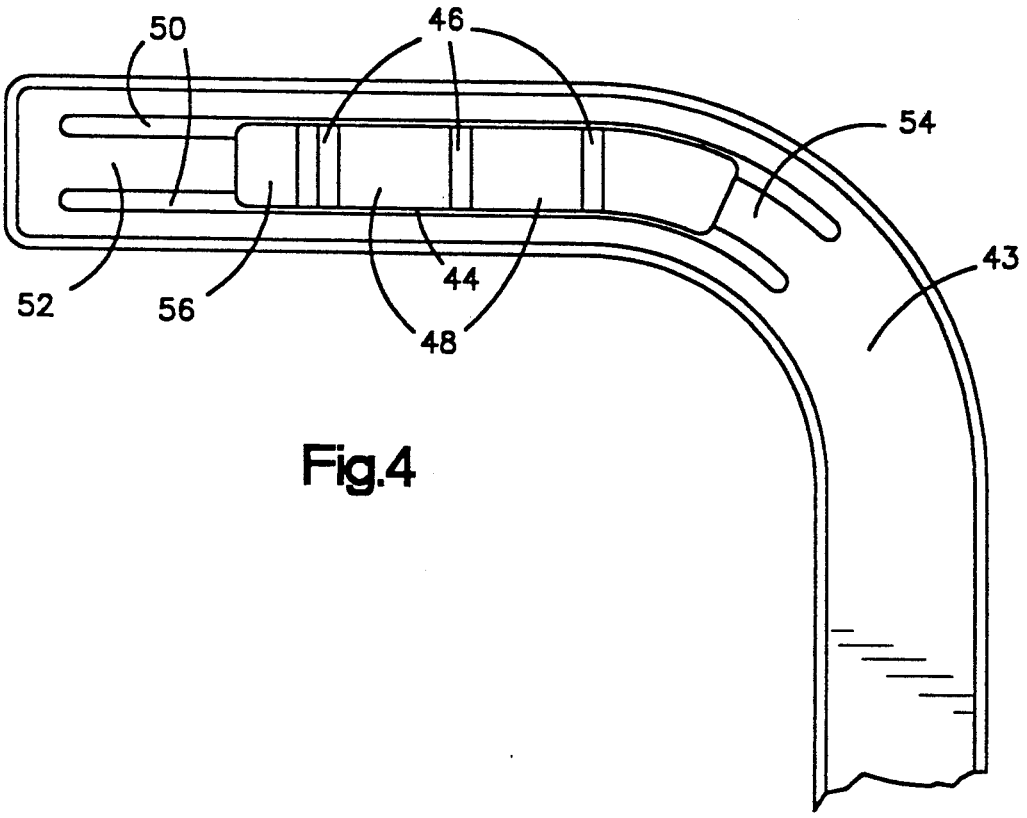
FIG. 4 is an enlarged fragmentary top view of the adjustable retainer shown in FIG. 2 showing the depressible release and associated features in greater detail.
Figure 5:
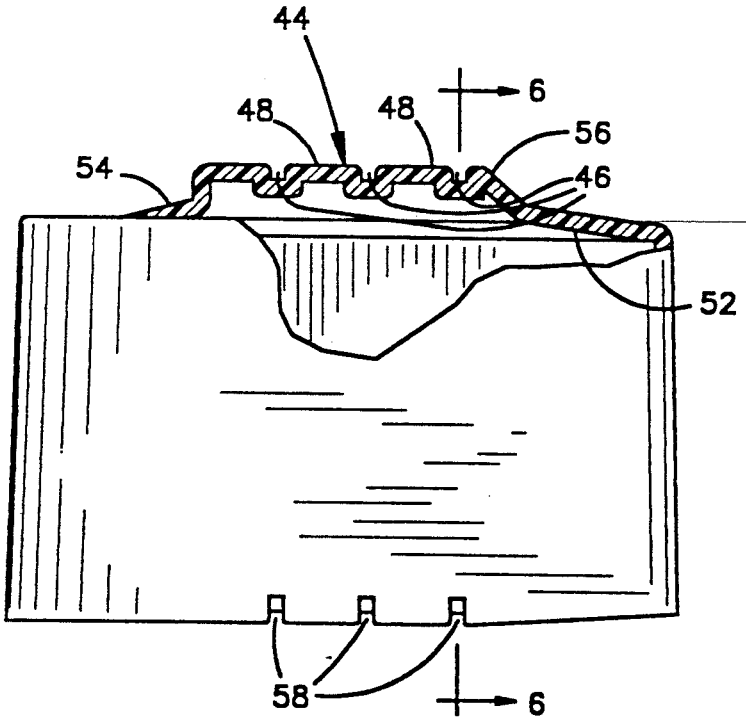
FIG. 5 is an enlarged side elevational view of the adjustable retainer shown in FIG. 2 with portions broken away to show the depressible release in greater detail.
Figure 6:
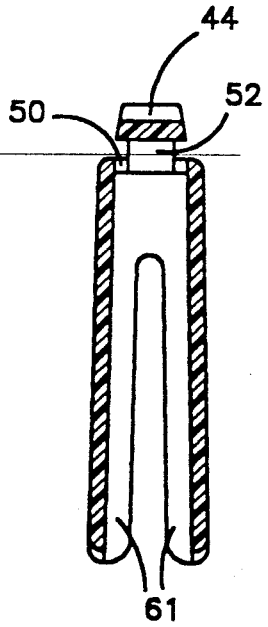
FIG. 6 is an elevational cross section of the sidewall portion of the adjustable retainer as viewed along lines 6—6 of FIG. 5.

As is best illustrated in FIGS. 4, 5 and 6, each sidewall portion has an integral depressible release 44 projecting from a substantially continuous edge surface 43. In accordance with the preferred embodiment, the release has three spaced recesses 46 or grooves which can engage and snugly receive the top edge of one of the apertures 45 provided in the door liner. The release 44 extends in the same direction as the length of the sidewalls 42 and the width of the release 44, which is approximately half the thickness of the associated vertical sidewall 40 or 42, is centered on the top of the sidewall. Horizontal sliding surfaces 48 are provided between the recesses to permit the release to slide beneath the top edge of the aperture 45 in the liner wall from one recess 46 to an adjacent recess. An inclined camming surface 56 is provided between the end of the release and the first recess to facilitate engagement of the top edge of the aperture in the liner wall with the first recess.

At the bottom edge of each sidewall 40 and 42 are three spaced notches 58, with each notch 58 being associated with a corresponding recess 46. Each recess 46 and its associated notch 50 on one sidewall has a corresponding recess and associated notch 50 on the other sidewall, all of which cooperate to engage the top and bottom edges of a pair of apertures 45 in the refrigerator door liner spaced and sized to snugly receive the ends of the sidewalls and thereby firmly support the retainer on the door liner at any of three adjustable shelf depth positions.

In accordance with the preferred embodiment, the vertical walls of the retainer are hollow and open at the bottom, as is best illustrated in FIG. 6, to provide an elevational cross section having approximately an inverted U-shape. This shape provides a sturdy, durable structure which saves on material and permits parallel, narrow slots 50 to be formed or cut into the top surface of each sidewall along the outer peripheral lengthwise edges of the release 44 and past the ends of the release to provide a flexible, resilient spring support 52 and 54 at each end of the release 44. The slots and spring supports allow the releases to be easily depressed by rasping the sidewalls with fingers under the sidewall and by pressing the releases with the thumbs.

Figure 9:
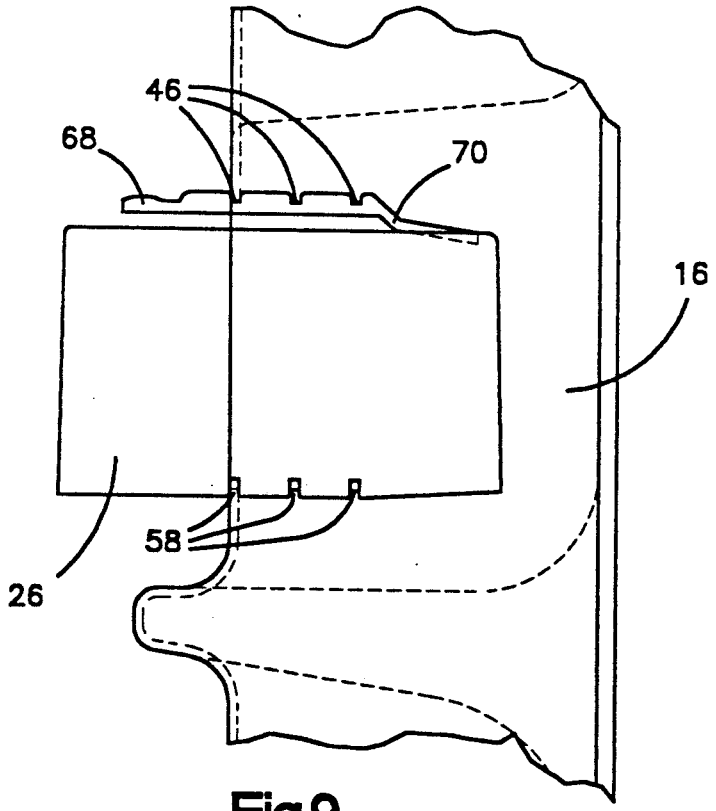
FIG. 9 is a side elevational view of a second embodiment of an adjustable retainer, wherein the release is a cantilever release supported by a single flexible, resilient spring support.

In accordance with the preferred embodiment, the spring supports are designed to bow, flex or compress, when the release is pressed toward the body of the retainer in a manner which causes the top surface of the release to maintain a substantially horizontal attitude during either the normal or the depressed conditions. It is also possible to provide a cantilever supported release 68 having a single spring support 70, such as shown in FIG. 9, or to design the spring supports so that the release rocks relative to the spring supports when depressed.

Figure 8A:
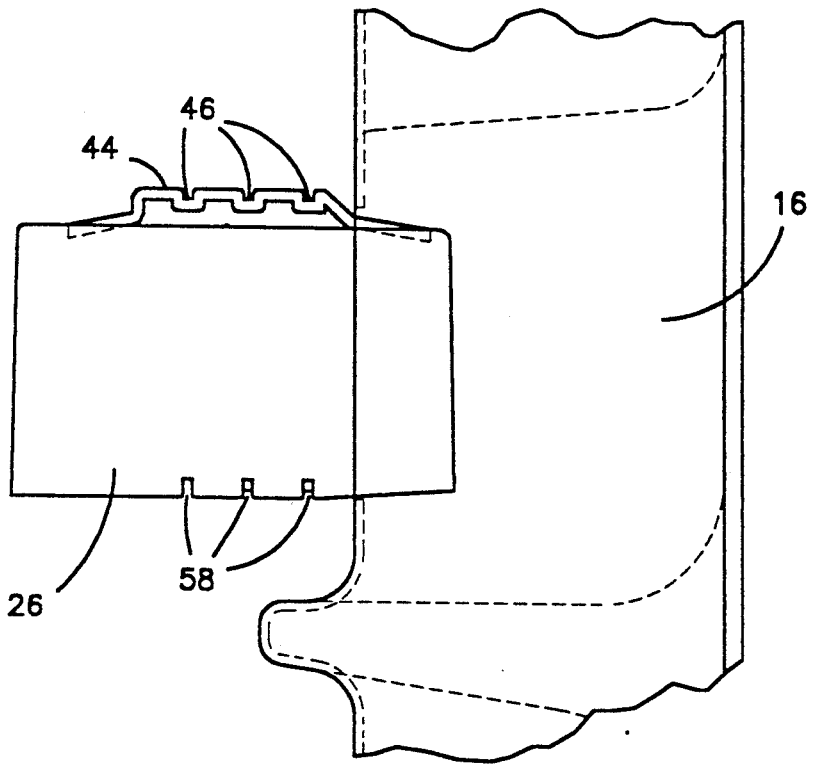
FIG. 8A shows a side elevational view of the adjustable retainer which has been partially inserted into an aperture in a refrigerator door liner.
Figure 8B:
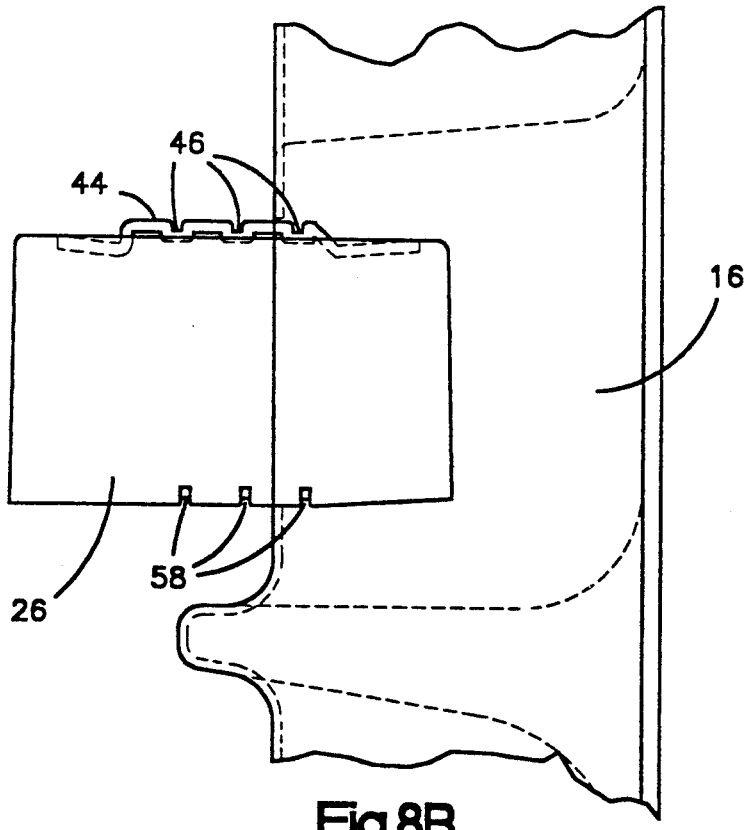
FIG. 8B shows the retainer from FIG. 8A with the depressible release pressed inward to Permit insertion of the retainer into the aperture of the refrigerator door liner.

The retainer is provided with in-turned ends 61 illustrated in FIG. 6, to facilitate easy insertion of the ends of the retainers into the apertures 45. The retainer is easily installed by sliding the ends of the retainer into the apertures 45 provided in the liner until the upper edge of the aperture 45 abuts the inclined camming surface as shown in FIG. 8A, then pressing down on the release and continuing to slide the retainer into the apertures 45 until the first notch 58 engages the bottom edge of the aperture. The top edge of the aperture 45 is then aligned with the first recess 46 and simultaneously releasing the release to allow it to spring upward so that the first recess engages the upper edge of the aperture 45.

Figure 8C:
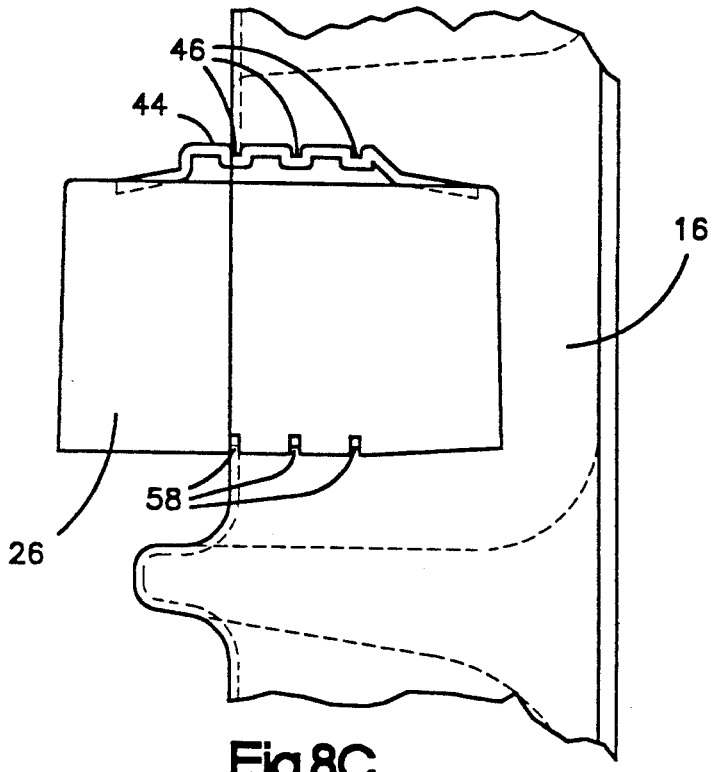
FIG. 8C shows the retainer from FIG. 8B locked into one of three positions provided by the recesses and notches.

The retainer can be easily adjusted to accommodate items of smaller width which are being held on the shelf by again grasping each sidewall, depressing the release 44 while simultaneously lifting up the sidewalls slightly to disengage the notches 58 from the bottom edge of the aperture 45, and then sliding the retainer into the liner to the next intermediate position in which the middle recess 46 and notch 58 locks with the top and bottom edges of the aperture 45. In accordance with the preferred embodiment shown in the drawings, the retainer can also be adjusted to a third position, as shown in FIG. 8C, to provide a narrow shelf. The retainer can subsequently be readjusted to provide a wider shelf or it can be completely removed for easy cleaning by simply depressing the release, lifting the sidewalls to disengage the notch 58 from the bottom edge of the aperture 45 in the liner, and sliding the retainer outward.

Referring again to FIG. 3, the recesses 46 are preferably U-shaped and the notches 58 preferably have an inverted U-shape of approximately the same dimension as the recesses. In any of the predetermined adjustable positions the recess engaging the edge of the aperture 45 in the door liner has a forward abutting surface 62 which acts with a rearward abutting surface 64 of the associated notch and the edges of the door liner aperture 45 to resist counter-clockwise movement of the retainer, as viewed in FIG. 3. Likewise, the rearward abutting surface 60 of the recess and the forward abutting surface 66 of the notch cooperate with the edges of the door liner aperture to resist clockwise movement of the retainer, as viewed in FIG. 3.

In accordance with the preferred embodiment, the sidewalls of the retainer extend from the front wall via a relatively large radius curved portion which prevents the retainer from being pushed past the notches and recesses closest to the curved portion, thereby preventing the retainer from becoming jammed into the apertures. Also, in accordance with the preferred embodiment, the sidewalls gradually taper from bottom to top, as shown in FIG. 6, to ensure tight fit between the liner and the retainer in any of the engaged positions.

While what is presently considered to be the most practical and preferred embodiments of the invention has been described, it is to be understood that the invention is not to be limited to the disclosed embodiments but, to the contrary, is intended to cover various modifications and equivalent arrangements included within the spirit and scope of the appended claims.

What is claimed is:

1. A horizontally adjustable retainer for a refrigerator door shelf, comprising: an elongated vertical front wall portion; two vertical sidewall portions of substantially equal length which extend, substantially at right angles and in the same direction, from the front wall portion, with each of the sidewall portions having opposed top and bottom edges; a resilient depressible release projecting from one of said edges of each sidewall portion, the outer surface of each release having a plurality of spaced recesses; and a plurality of spaced notches in the other of said edges with one notch and an associated recess at each sidewall portion cooperating to engage the top and bottom edges of an aperture in a refrigerator door liner, thereby rigidly fixing the retainer to the refrigerator door liner at one of a plurality of predetermined positions.

2. A retainer in accordance with claim 1, wherein the recesses are elongated grooves with the length direction of the recesses being perpendicular to the plane of the sidewall portions, and with each recess on one sidewall portion being in alignment with a corresponding recess on the other sidewall portion.

3. A retainer in accordance with claim 1, wherein each notch is in alignment with its associated recess.

4. A retainer in accordance With claim 1 which is formed as a continuous unitary structure

5. A retainer in accordance with claim 4 which is injection molded from a thermoplastic material.

6. A retainer in accordance with claim 5, wherein the thermoplastic material is an acrylic butadiene styrene copolymer.

7. A retainer in accordance with claim 5, wherein the thermoplastic material is a polypropylene polymer.

8. A retainer in accordance with claim 1, wherein a release is at the top edge of each sidewall portion, and the notches are at the bottom edge of each sidewall portion.

9. A retainer in accordance with claim 1, wherein the wall's of the retainer are hollow and open at one edge to provide an elevational cross section having approximately an inverted U-shape, and have narrow slots formed into the top surface of each sidewall along the outer peripheral lengthwise edge of each release and past the ends of each release to provide a flexible, resilient spring support at each end of the release, the spring supports flexing when the release is pressed toward the body of the retainer with the outer surface of the release remaining substantially horizontal whether in its normal or depressed condition.

10. A retainer in accordance with claim 1, wherein the walls of the retainer are hollow and open at one edge to provide an elevational cross section having approximately a U-shape, with each release having a single flexible, resilient spring support.

11. A retainer in accordance with claim 1, wherein the sidewall portions extend from the front wall via curved portions which prevents the retainer from being inserted into the liner apertures past the recesses and associated notches closest to the front wall portion, thereby preventing the retainer from becoming jammed into the refrigerator liner.

12. A retainer in accordance with claim 1, wherein the sidewall portions are tapered from bottom to top to provide additional rigidity between the liner and the retainer member in any of the plurality of engaged positions.

13. A refrigerator door comprising a door having an elongated shelf extending from a back edge to a forward edge, a retainer mounted on said door providing a forward wall extending substantially parallel to said front edge of said shelf and lateral end portions substantially at the ends of said shelf, said end portions and said door providing adjustable mounting means operable to mount said retainer on said door in a plurality of positions for adjusting the spacing between said forward wall and said back edge of said shelf to accommodate the storage of items having different widths.

* * * * *

UNITED STATES PATENT AND TRADEMARK OFFICE

CERTIFICATE OF CORRECTION

PATENT NO. : 5,160,191

DATED : November 3, 1992

INVENTOR(S) : James R. Holland and Charles J. Hoffman

It is certified that error appears in the above-identified patent and that said Letters Patent is hereby corrected as shown below:

Column 4, line 9, delete "rasping" and insert --grasping--.

Column 5, Claim 4, line 1, delete "With" and insert --with--.

Claim 4, line 2, after "structure" insert --.-- (period).

Column 6, Claim 9, line 2, delete "wall's" and insert --walls--.

Signed and Sealed this

Twelfth Day of October, 1993

*Attest:*

Bruce Lehman

BRUCE LEHMAN

*Attesting Officer*

*Commissioner of Patents and Trademarks*